US008361554B2

(12) United States Patent
Majima et al.

(10) Patent No.: US 8,361,554 B2
(45) Date of Patent: Jan. 29, 2013

(54) APPARATUS AND METHOD FOR BAR COATING

(75) Inventors: Wataru Majima, Odawara (JP); Nobuo Hamamoto, Odawara (JP)

(73) Assignee: FUJIFILM Corporation, Tokyo (JP)

( * ) Notice: Subject to any disclaimer, the term of this patent is extended or adjusted under 35 U.S.C. 154(b) by 1213 days.

(21) Appl. No.: 11/947,312

(22) Filed: Nov. 29, 2007

(65) Prior Publication Data

US 2008/0124477 A1 May 29, 2008

(30) Foreign Application Priority Data

Nov. 29, 2006 (JP) ..... 2006-322452

(51) Int. Cl.
*B05D 3/12* (2006.01)

(52) U.S. Cl. ..... 427/359; 427/428.01; 118/110

(58) Field of Classification Search ..... 427/359, 427/361, 428.01, 428.06, 428.2; 118/110, 118/118, 119, 414, 200, 244, 258, 259
See application file for complete search history.

(56) References Cited

U.S. PATENT DOCUMENTS

| | | | |
|---|---|---|---|
| 4,263,870 | A | 4/1981 | Saito et al. |
| 2005/0109272 | A1 * | 5/2005 | Ooshima et al. ..... 118/110 |

FOREIGN PATENT DOCUMENTS

| | | | |
|---|---|---|---|
| JP | 58-4589 | B2 | 1/1983 |
| JP | 9-201563 | A | 8/1997 |
| JP | 2001-087697 | A | 4/2001 |
| JP | 2003-159559 | A | 6/2003 |
| JP | 2005-046751 | A | 2/2005 |
| JP | 2006-82059 | A | 3/2006 |

OTHER PUBLICATIONS

Notice of Reasons for Rejection, dated Aug. 23, 2011, issued in corresponding JP Application No. 2006-322452, 4 pages in English and Japanese.

* cited by examiner

*Primary Examiner* — Michael Cleveland
*Assistant Examiner* — Tabatha Penny
(74) *Attorney, Agent, or Firm* — Sughrue Mion, PLLC

(57) ABSTRACT

In a bar coating apparatus which applies a coating liquid to a continuously running web using a columnar bar which rotates by being supported by a bar receiving member, the bar to be used is determined based on D*, where A is a deflection value of a difference between a maximum value and minimum value of roundness of the bar, B is a value obtained by a second-order approximation of A in a width direction X of the bar, T (=A−B) is a value obtained by subtracting B from A, and D* is an average inclination which is an average of a bar width of an absolute value |dT/dX| of a differential value of T in the width direction X of the bar.

1 Claim, 10 Drawing Sheets

APPARATUS AND METHOD FOR BAR COATING

BACKGROUND OF THE INVENTION

1. Field of the Invention

The present invention relates to an apparatus and method for bar coating, and more particularly, to an apparatus and method for bar coating which applies a coating liquid to a continuously running web with a columnar bar having a small diameter of 5 mm to 15 mm inclusive.

2. Description of the Related Art

Conventionally, various methods are proposed as methods of applying a coating liquid to a continuously running web, and as shown in Japanese Patent Application Laid-Open No. S58-4589 or the like, a bar coating method which is easy to operate and does not require much space is widely used. However, since the bar is long, stepped coating thickness unevenness (hereinafter, referred to as "traverse step-like unevenness") are likely to occur in the web running direction due to minute vibration of the web or the bar, and as a countermeasure for this, the applicant of the present invention proposed, in Japanese Patent Application Laid-Open No. H09-201563, a bar coating method whereby, when it is assumed that a lap angle between the web and the bar is 2.5° to 30° inclusive, the maximum diameter of the bar cross-section is Rb and the curvature radius of the arc of the cross-section of the bar receiving member of the bar support member is Rh, Rb/Rh is set to within a range from 0.9 to 1.0 inclusive and the bar hold angle of the bar support member is set to 90° to 180° inclusive. In this way, it is possible to solve traverse step-like unevenness.

Furthermore, Japanese Patent Application Laid-Open No. 2006-82059 proposes to adjust straightness and roundness of the whole bar in order to apply a thin film to the web without producing traverse step-like unevenness.

However, even when the bar coating methods according to Japanese Patent Application Laid-Open No. H09-201563 and Japanese Patent Application Laid-Open No. 2006-82059 are used, there is a problem that traverse step-like unevenness occurs in the web width direction for every turn of the bar on the coating surface of the web onto which the coating liquid has been applied. Especially, as for thin film coating applied to a web where a wet film thickness is 15 μm or less as in the case of coating when manufacturing an optically functional film such as optically compensated film, it is difficult to obtain a leveling effect after coating and these coating faults become easily apparent, which is problematic.

However, even if the straightness or roundness of the whole bar is adjusted, there is a problem that the occurrence of traverse step-like unevenness cannot be prevented during bar coating.

The present invention has been implemented in view of the above described circumstances and it is an object of the present invention to provide an apparatus and method for bar coating capable of applying a coating liquid to a web as a thin film so as not to produce any traverse step-like unevenness during bar coating.

SUMMARY OF THE INVENTION

In order to attain the above described object, a first aspect of the present invention provides a bar coating apparatus which applies a coating liquid to a continuously running web using a columnar bar which rotates by being supported by a bar receiving member, including a bar which satisfies $D^* \leqq 135\times10^{-6}$ where A is a deflection value of a difference between a maximum value and minimum value of roundness of the bar, B is a value obtained by a second-order approximation of A in a width direction X of the bar, T (=A−B) is a value obtained by subtracting B from A, and D* is an average inclination which is an average of a bar width of an absolute value |dT/dX| of a differential value of T in the width direction X of the bar.

leveling effect The inventor has acquired knowledge that as the cause for the occurrence of traverse step-like unevenness in bar coating, minute deflection of straightness of the bar has a greater influence on traverse step-like unevenness rather than deflection of straightness of the whole bar. Moreover, the inventor has acquired knowledge that by specifying the average inclination D* to $135\times10^{-6}$ or less as the minute deflection of straightness of the bar, it is possible to prevent traverse step-like unevenness. The present invention has been implemented based on such knowledge.

According to the first aspect of the present invention, since the bar average inclination D* is set to $D^* \leqq 135\times10^{-6}$, it is possible to accurately rotate the bar by being supported by the bar support surface and thereby prevent the occurrence of traverse step-like unevenness in bar coating.

Furthermore, according to the first aspect of the present invention, instead of adopting an average inclination of the deflection value A of the difference between a maximum value and minimum value of roundness of the bar as the average inclination D* of the bar, the invention adopts a width average of absolute value |dT/dX| of the differential value of the value T in the width direction X of the bar obtained by subtracting the value B which is a second-order approximation of A in the width direction X from this A, and therefore even a bar which is normally deflected to an extent is pressed against the supporting body during coating and deflection thereof is removed, and it is possible to distinguish a bar to which coating is applicable without coating unevenness and use the bar for the coating apparatus. This makes it possible to prevent the occurrence of coating faults such as coating unevenness when performing bar coating using the coating apparatus.

A second aspect of the present invention is the first aspect of the present invention, wherein the bar is wound with a wire whose diameter is 0.06 mm to 0.4 mm inclusive.

According to the second aspect of the present invention, it is possible to effectively suppress traverse step-like unevenness which becomes apparent when forming a coating film of approximately 15 μm in thickness with a wire diameter of 0.4 mm.

A third aspect of the present invention is a bar coating method of applying a coating liquid to a continuously running web using a columnar bar which rotates by being supported by a bar receiving member, using the bar which satisfies $D^* \leqq 135\times10^{-6}$ where A is a deflection value of a difference between a maximum value and minimum value of roundness of the bar, B is a value obtained by a second-order approximation of A in a width direction X of the bar, T (=A−B) is a value obtained by subtracting B from A, and D* is an average inclination which is an average of a bar width of an absolute value |dT/dX| of a differential value of T in the width direction X of the bar.

According to the third aspect of the present invention, it is possible to apply a coating liquid to a running web as a thin film so as not to produce traverse step-like unevenness.

According to the bar coating apparatus and method of the present invention, a coating liquid can be applied to a web as a thin film so as not to produce traverse step-like unevenness. Therefore, the present invention is extremely effective in improving surface properties of a coating surface in thin-film coating as in the case of, for example, manufacturing of an optically functional film.

DETAILED DESCRIPTION OF THE PREFERRED EMBODIMENTS

Hereinafter, preferred embodiments of a bar coating method and apparatus according to the present invention will be explained with reference to the attached drawings.

Figure 1:
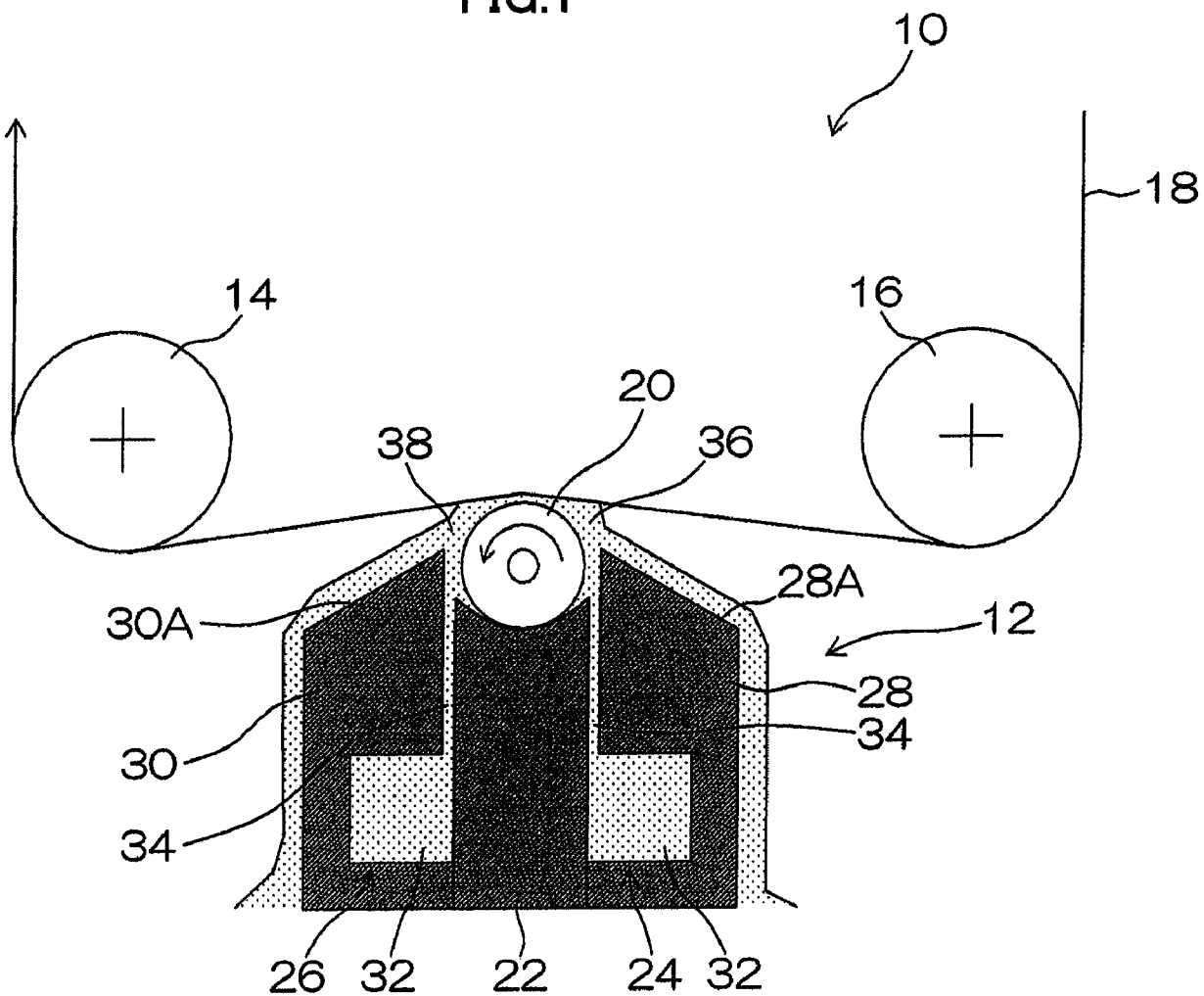
FIG. 1 is a side cross-sectional view of a bar coating apparatus of the present invention.
Figure 2:
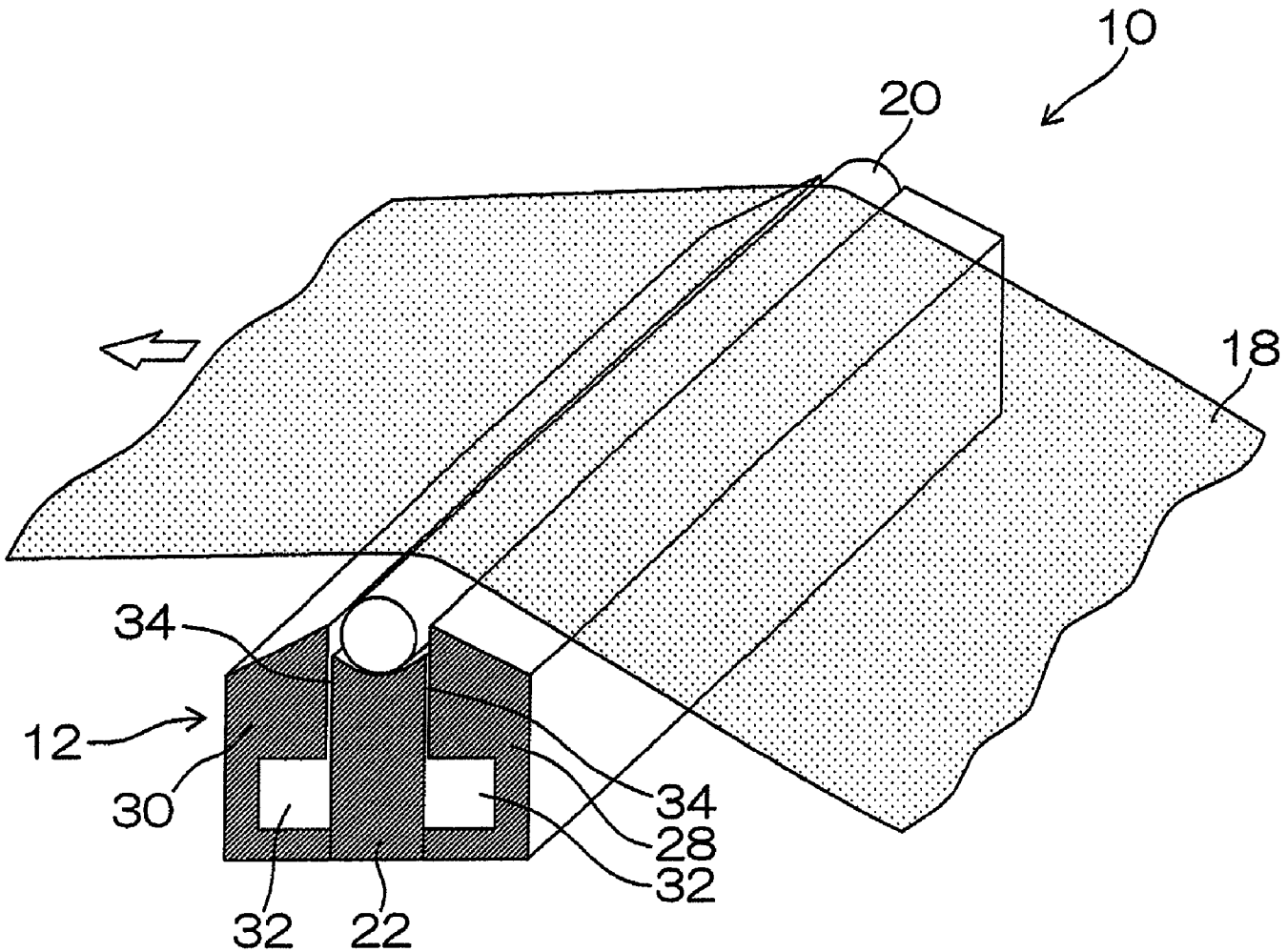
FIG. 2 is a perspective view showing a cross-section of part of the bar coating apparatus of the present invention.

FIG. 1 is a side cross-sectional view of a bar coating apparatus showing an embodiment of the present invention and FIG. 2 is a perspective view showing a cross-section of part of a bar coating head.

As shown in FIG. 1 and FIG. 2, a bar coating apparatus 10 applies a coating liquid with a web 18 lapped on a bar 20 of a bar coating head 12 through a pair of guide rollers 14, 16 provided upstream and downstream in the web running direction on both sides of the bar coating head 12.

The bar coating head 12 is constructed of the bar 20 rotatably supported by bearings (not shown) at both ends thereof, a bar receiving member 22 provided along the entire length of the bar 20 and having a function of preventing deflection from occurring in the bar 20 and a function as a liquid supplier which supplies a coating liquid to the bar 20, an upstream shuttering member 28 and a downstream shuttering member 30, which respectively form, between the bar receiving member 22 and themselves, liquid supply channels 24 and 26 to supply a coating liquid. The liquid supply channels 24, 26 are constructed of a manifold 32 and a slot 34 and the coating liquid supplied to the manifold 32 is uniformly extruded in the width direction of the web 18 through the slot 34. This causes a primary side bead 36 to be formed upstream in the conveyance direction of the web 18 (hereinafter, referred to as a "primary side") and a secondary side bead 38 to be formed downstream (hereinafter, referred to as a "secondary side") with respect to the bar 20. This secondary side bead 38 acts so as not to entrap air between the bar 20 and bar receiving member 22. The coating liquid forming these primary side and secondary side beads 36, 38 is picked up by the rotating bar 20, thereby lapped onto the bar 20 and applied to the continuously running web 18. Furthermore, of the coating liquid supplied to the primary side and secondary side beads 36, 38 from the liquid supply channels 24, 26, an excess coating liquid flows through outsides 28A, 38A of the shuttering members 28, 30.

Figure 3:
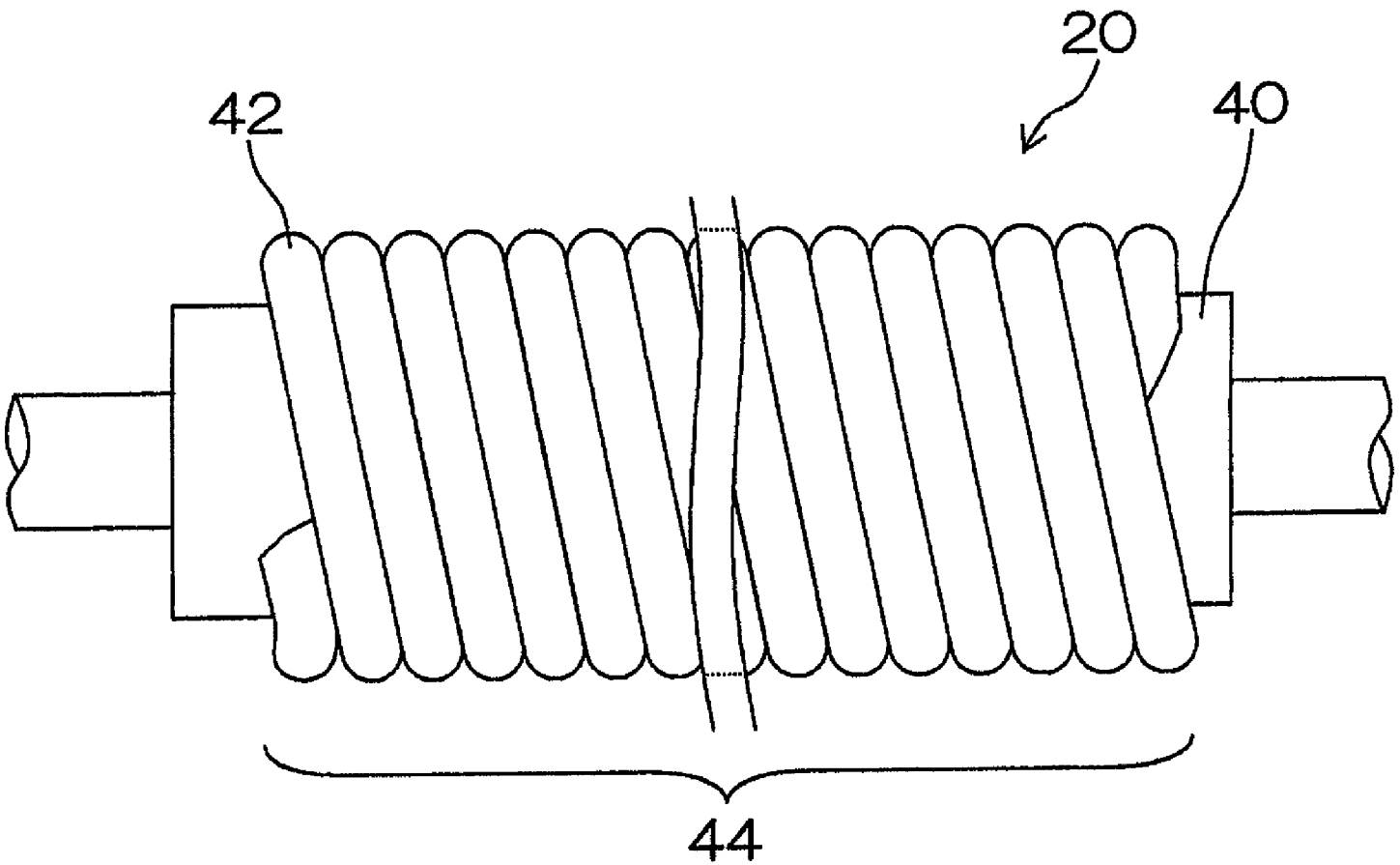
FIG. 3 is a diagram illustrating a wire bar.
Figure 4:
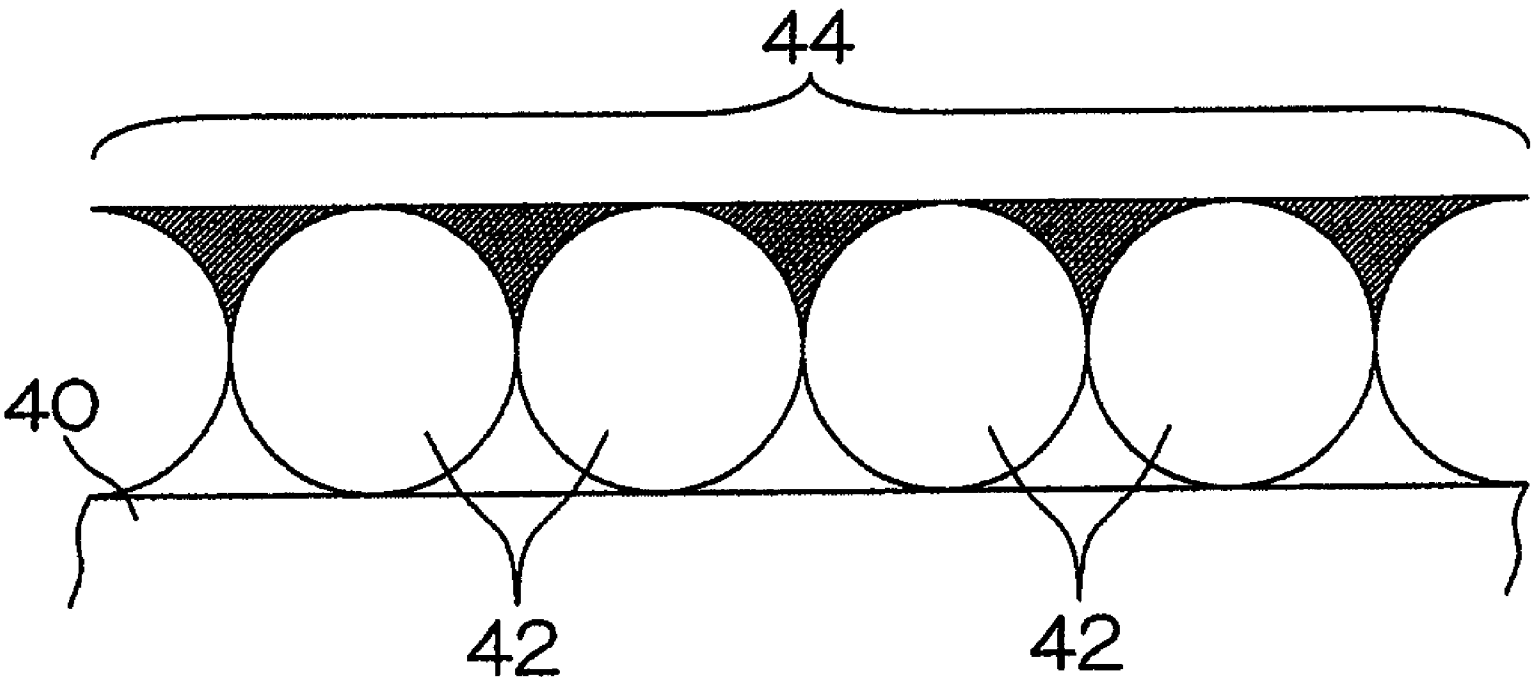
FIG. 4 is a diagram illustrating an adjustment of a coating liquid on the wire bar.

The bar 20 may rotate following the running of the web 18 or may be driven to rotate by a given driving source and may rotate in the same direction as the running direction of the web 18 or in a direction opposite thereto. As the type of the bar 20, a wire bar or grooved bar can be preferably used and the wire bar 20 is preferably used for thin film coating when the thickness of a wet film applied to the web 18 is 15 μm or less as in the case of manufacturing of an optically functional film such as an optically compensated film in particular because the amount of coating can be accurately controlled, ideal for thin film coating. The wire bar 20 is created by winding a wire 42 around the surface of a columnar cored bar 40 and forming a wire row 44 as shown in FIG. 3. As shown in FIG. 4, the wire bar 20 can change the amount of coating liquid held between the wires 42 of the wire row 44 by changing the diameter of the wire 42 and this allows the coating film of a desired thickness to be accurately applied.

When the wire bar is used in the present invention, the diameter of the bar 20 is 5 mm to 15 mm inclusive or more preferably 5 mm to 10 mm inclusive. The bar 20 used in the present invention is of a small diameter within a range of 5 mm to 15 mm inclusive and of a length of 2 m or less. This is because the bar 20 is long and thin, and whirling due to deflection is likely to occur while the bar 20 is rotating. On the other hand, it is difficult to manufacture a bar 20 having a diameter of less than 5 mm.

Furthermore, the bar 20 used is one having an average inclination D* that satisfies $D^* \leqq 135\times10^{-6}$. Here, the average inclination D* refers to a width average of a differential value $|dT/dX|$ of T in a width direction X, where A is a deflection value of a difference between a maximum value and minimum value of roundness of the bar 20, B is a value obtained by a second-order approximation of A in a width direction X, T (=A−B) is a value obtained by subtracting B from A. The roundness refers to a difference between a maximum value and minimum value of deflection of the radius measured when the bar 20 is rotated by one turn around the axis center of the bar 20. A non-contact laser displacement gauge is preferable for measurement of the deflection value, but a contact type dial gauge or taper gauge may also be used. When the bar 20 is rotated to measure the deflection value, measurement is performed with the axis of the bar 20 arranged in a vertical direction and both the top and bottom thereof fixed so as to exclude deflection. The interval of measuring the deflection value A of roundness in the width direction X may be an arbitrary value, but for the accuracy of differentiation, suppose the measurement interval is 2πd or less where d is the diameter of the bar 20. The deflection value A of roundness obtained in this way is a function of the width direction X, but since the top and bottom are fixed, a deflection component is likely to occur. There are cases where deflection actually exists, but as disclosed in Japanese Patent Application Laid-Open No. 2004-230352, the deflection component is actually regulated because the bar is lapped by the web. Greater accuracy may be attained by defining an "average inclination D*" which becomes a typical value of a variation of deflection after excluding this deflection component. Therefore, a variation of a value T (=A−B) obtained by subtracting a value B ($=aX^2+bX+c$) obtained by a second-order approximation of the defection value A in the width direction X from the deflection value A has been evaluated.

This variation is calculated by:

$$\frac{\int\left|\frac{dT}{dX}\right|dX}{L}$$

where L is the length of the bar, but since the differentiation of discrete values varies greatly depending on an S/N ratio of data, a differential calculation of "dT/dX" is carried out using a least-square method. Here, a more specific method of calculating the average inclination D* will be explained.

Suppose a rectilinear approximation expression obtained at N points before and after a certain point of interest "n" (here, simply a total of 5 points, two points before and after) is:

$$T=a(n)\times i+b(n)$$

Then, a minimum square sum ϵ of these 5 points is:

$$\epsilon=\Sigma(i=-2 \text{ to } +2)[T(i)-a(n)\times i-b(n)]^2$$

Since a(n) in (Formula 1) obtained so as to minimize (Formula 2) is a differential value at point n, a(n) can be calculated which satisfies:

$$\frac{\partial\varepsilon}{\partial a}=0$$

Since this is:

$$\begin{aligned}\frac{\partial\varepsilon}{\partial a}&=-2\sum(i=-2\sim+2)[i\times T(i)-a(n)\times i^2-b(n)\times i]\\&=-2\left\{\sum[i\times T(i)]-a(n)\times\sum i^2-b(n)\times a(n)\times i\right\}\\&=-2\left\{\sum[i\times T(i)]-a(n)\times\right.\\&\quad[(-2)^2=(-1)^2+(0)^2+(+1)^2+(+2)^2]-\\&\quad\left.b(n)\times[(-2)+(-1)+(0)+(+1)+(+2)]\right\}\\&=-2\left\{\sum[i\times T(i)]-a(n)\times 10\right\}=0\\a(n)&=\sum(i=-2 \text{ to } +2)[i\times T(i)]/10\end{aligned}$$

In the case of one point before and after, a(n) is calculated likewise:

$$a(n)=\Sigma(i=-1 \text{ to } +1)[i\times T(i)]/2$$

In the case of three points before and after, a(n) is calculated likewise:

$$a(n)=\Sigma(i=-3 \text{ to } +3)[i\times T(i)]/28$$

In the case of four points before and after, a(n) is calculated likewise:

$$a(n)=\Sigma(i=-4 \text{ to } +4)[i\times T(i)]/60$$

In the present invention, i may be an arbitrary value equal to or greater than 1, but i=1 to 3 for a system having a small measurement error or i=3 to 6/N for a system having a large measurement error is actually preferable. Here, N is the number of measurement points. The average inclination D* calculated through the above calculations becomes an index indicating a property of traverse step-like unevenness.

Next, the reason that the average inclination D* that satisfies $D^*\leqq 135\times10^{-6}$ is used for the bar 20 will be explained.

Figure 5:
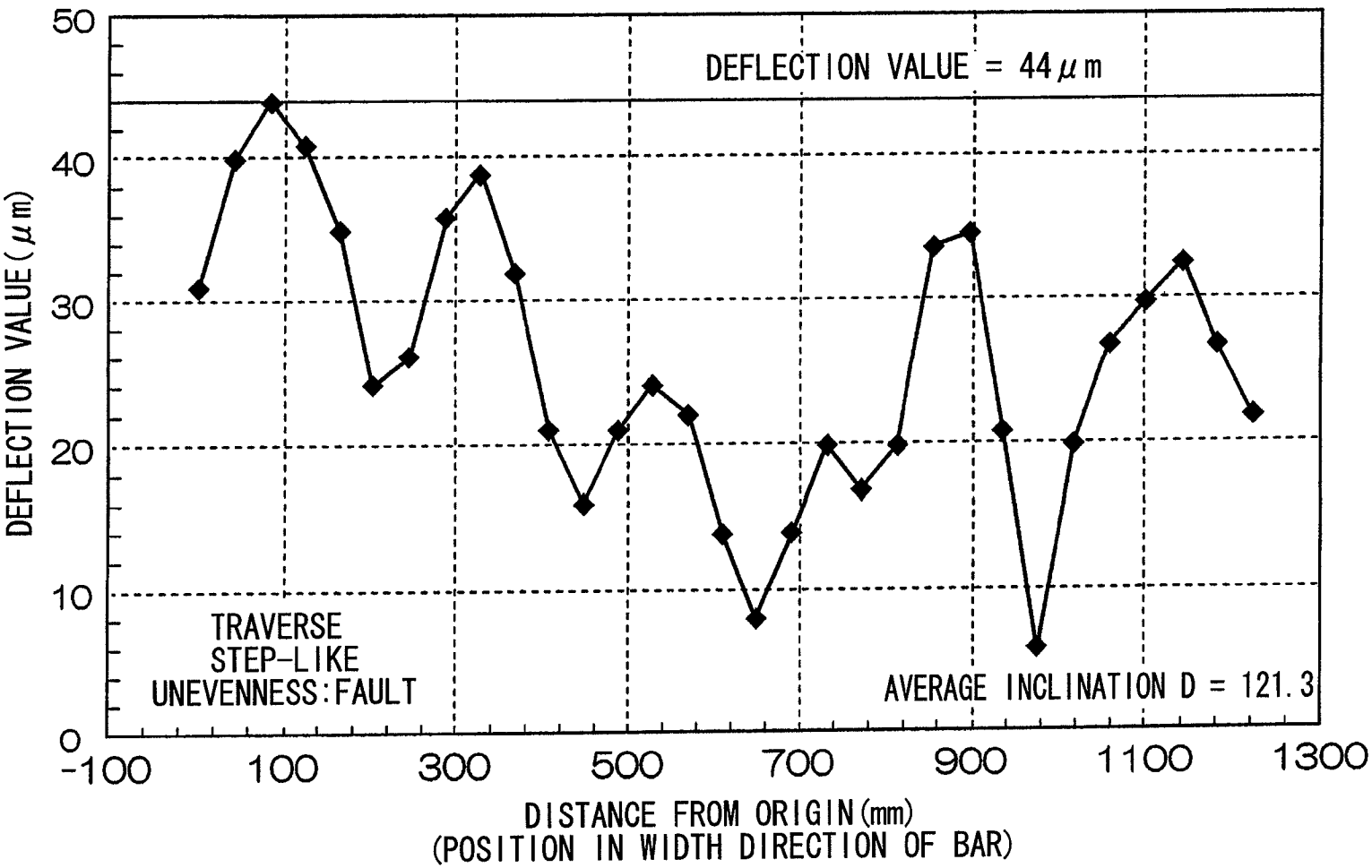
FIG. 5 is a graph showing a relationship between positions in the width direction of the bar and deflection values measured at the respective positions.
Figure 6:
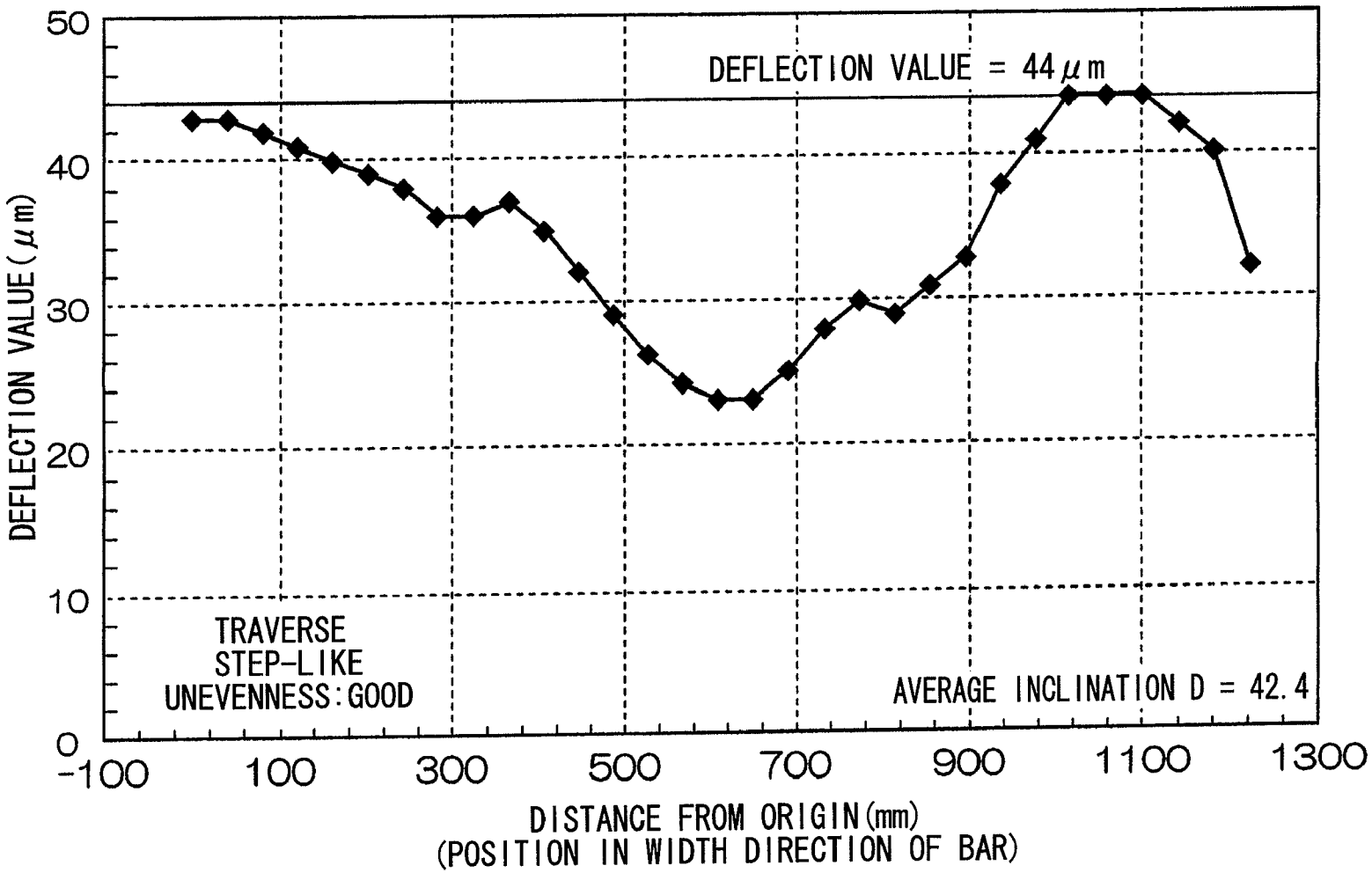
FIG. 6 is a graph showing a relationship between positions in the width direction of the bar and deflection values measured at the respective positions.

FIG. 5 and FIG. 6 are graphs showing a relationship between the positions in the width direction of the bar 20 and the deflection values measured at the respective positions.

As shown in FIG. 5 and FIG. 6, even when the maximum value of deflection value of the bar 20 is the same 44 μm, when the average inclination D (=dA/dX) is calculated about the bar 20 shown in the respective figures, the average inclination D is 121.3 with the bar 20 shown in FIG. 5 and the average inclination is 42.4 with the bar 20 shown in FIG. 6. When thin film coating was performed on the web 18 using the bar 20 shown in FIG. 5, traverse step-like unevenness occurred in the formed coating film, whereas when thin film coating was performed on the web 18 using the bar 20 shown in FIG. 6, no traverse step-like unevenness was observed in the formed coating film. This shows that when bar coating is performed on the web 18, it is possible to form a coating film without traverse step-like unevenness on the web 18 when the bar 20 whose average inclination D falls within a predetermined range is used instead of a maximum value of the deflection value in the width direction of the bar 20.

Figure 7:
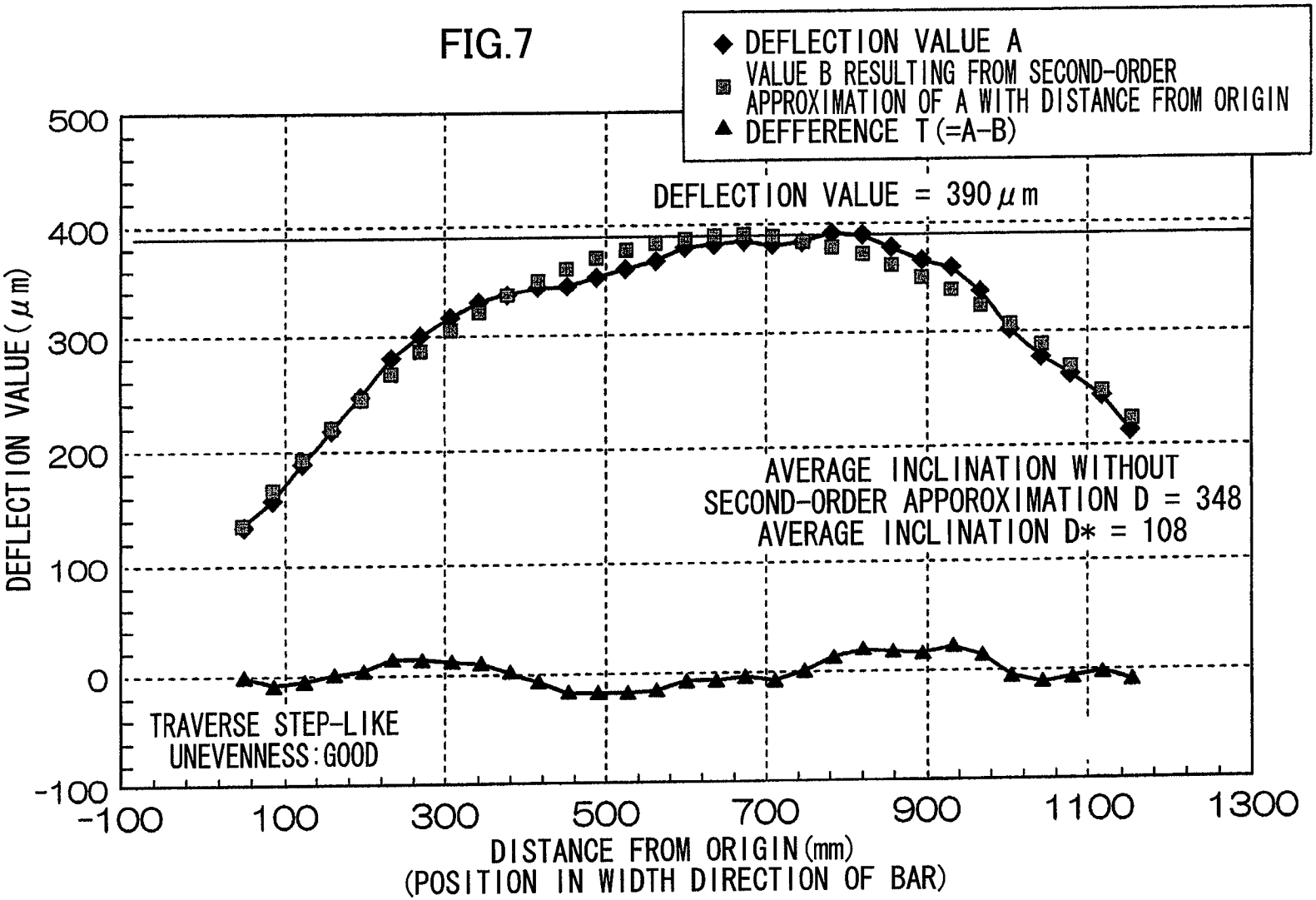
FIG. 7 is a graph showing a relationship between positions in the width direction of the bar and deflection values, average inclination D and average inclination D* measured at the respective positions.

Furthermore, FIG. 7 is a graph showing a relationship between the positions in the width direction of the bar 20, deflection values, average inclination D and average inclination D* measured at the respective positions.

FIG. 7 shows the bar 20, a maximum value of deflection of which is as large as 390 μm. The average inclination D (=dA/dX) of this bar 20 is calculated to be 348, showing that the bar 20 is deflected to an extent. However, a variation of the value T (=A−B) obtained by subtracting a value B ($=aX^2+bX+c$) which is obtained by a second-order approximation of a deflection value A in the width direction X from the deflection value A was evaluated and an average inclination D* thereof was calculated to be 108. Moreover, FIG. 7 shows that when bar coating is performed on the web 18 using this bar 20, it is possible to form a coating film without traverse step-like unevenness on the web 18. This fact shows that even when the bar 20 is deflected to an extent, by setting the bar 20 in the bar receiving member 22 during bar coating, lapping the web 18 onto this bar 20 with certain tension and pressing the bar 20 against the web 18, it is possible to remove deflection of the bar 20 and obtain the web 18 in which a coating film free of traverse step-like unevenness is formed.

Therefore, when forming a coating film on the web 18 through bar coating, if attention is focused on the average inclination D* and a bar that satisfies the condition of $D^*\leqq 135\times10^{-6}$ is used, it is possible to press not only the bar 20 having no deflection before actual bar coating but also the bar 20 having a certain degree of deflection against the web 18 and eliminate this deflection during bar coating and thereby form a coating film with no traverse step-like unevenness on the web 18.

The appropriate diameter of the wire 42 used in the present invention is 0.06 mm to 0.4 mm inclusive, and preferably 0.06 mm to 0.2 mm inclusive. When the diameter is greater than this, the amount of coating becomes excessive, which is not appropriate as a bar coating method effective for high-speed thin film coating, whereas when the diameter is smaller than this, it is difficult to manufacture a high precision wire bar by winding the wire 42 and there is also a problem with strength. Metal is used as the material of the wire 42, but stainless steel is most appropriate from the standpoint of corrosion resistance, wear resistance and strength or the like. Plating may also be applied to the surface to improve wear resistance of this wire 42. Especially, hard chrome plating is appropriate.

In this way, it is possible to obtain a thin coating film having a wet thickness of 5 μm to 15 μm inclusive by applying a coating liquid having viscosity of 0.02 Pa·s to the web 18 using a wire bar having a bar diameter of 5 mm to 15 mm inclusive, a wire diameter of 0.06 mm to 0.4 mm inclusive.

Furthermore, when a grooved bar is used in the present invention, the diameter of the bar is 5 mm to 15 mm inclusive and preferably 5 mm to 10 mm inclusive. The groove pitch is 0.1 mm to 0.5 mm inclusive and preferably 0.2 mm to 0.3 mm inclusive, and as the cross-sectional shape, one approximate to a sine curve is especially suitable. However, the cross-sectional shape is not necessarily limited to this and other sectional shapes may also be used. Generally, the grooved bar and wire bar have a certain correlation and when the areas per unit length are equal between the rooms which exist below a line connecting vertices of protrusions in the respective cross-sections, those bars are believed to be suitable for the same amount of coating under the same conditions. Therefore, based on such a correlation, it is possible to select an appropriate thinly-sliced bar according to the knowledge of the wire bar. As the material of the bar 20, metal is preferable from the standpoint of corrosion resistance and strength and stainless steel is especially suitable. Furthermore, as the material of the grooved bar, metal, and stainless steel in particular is suitable from the standpoint of corrosion resistance, strength and wear resistance.

As for the bar receiving member 22, since the bar 20 rotates at a high speed, a material having small frictional resistance with the bar (wire in the case of the wire bar) 20 should be selected. Examples of the material of the bar receiving member 22 preferably used in the present invention include fluoric resin, polyacetal resin, polyethylene resin, polystyrene resin or the like. Among them, polytetrafluoroethylene known under the name of Teflon (trade name of E. I. du Pont de Nemours and Company, USA), polyacetal resin known under the name of Delrin (trade name of E. I. du Pont de Nemours and Company, USA) are particularly preferable from the standpoint of frictional coefficient and strength. Furthermore, these plastic materials with a filler such as glass fiber, graphite, molybdenum disulfide added may also be used. Furthermore, after manufacturing the bar receiving member 22 with a metallic material, the frictional coefficient with respect to the bar 20 may also be reduced by coating or pasting the aforementioned plastic materials to the surface thereof. Alternatively, various metallic materials impregnated with the aforementioned plastic materials, for example, aluminum impregnated with polytetrafluoroethylene may also be used for the bar support member.

The appropriate size of the beads 36, 38 in the present invention vary depending on various conditions, but since the size varies depending on physical properties such as viscosity of the coating liquid, structure and rotation speed of the bar 20, running speed of the web 18 or the like, defining the size of the beads 36, 38 is not particularly meaningful and rather it is more realistic to study how to select these parameters that can be controlled. Since a plurality of parameters are involved in a complicated manner, how to select these conditions should be determined experimentally after all. Generally speaking, the relative ratio Vb/Vw between a rotation circumferential velocity Vb of the bar 20 and running speed Vw of the web 18 is often 1 and when this relative ratio is assumed to be 1, the critical speed of Vw during coating tends to increase as the viscosity of the coating liquid decreases or the diameter of the bar decreases, but since a reduction of density of the coating liquid aiming at a reduction of viscosity, a reduction of the diameter of the bar will cause degradation of drying unevenness and whirling of the bar, an optimal combination of viscosity of the coating liquid and the diameter of the bar is required.

Figure 8:
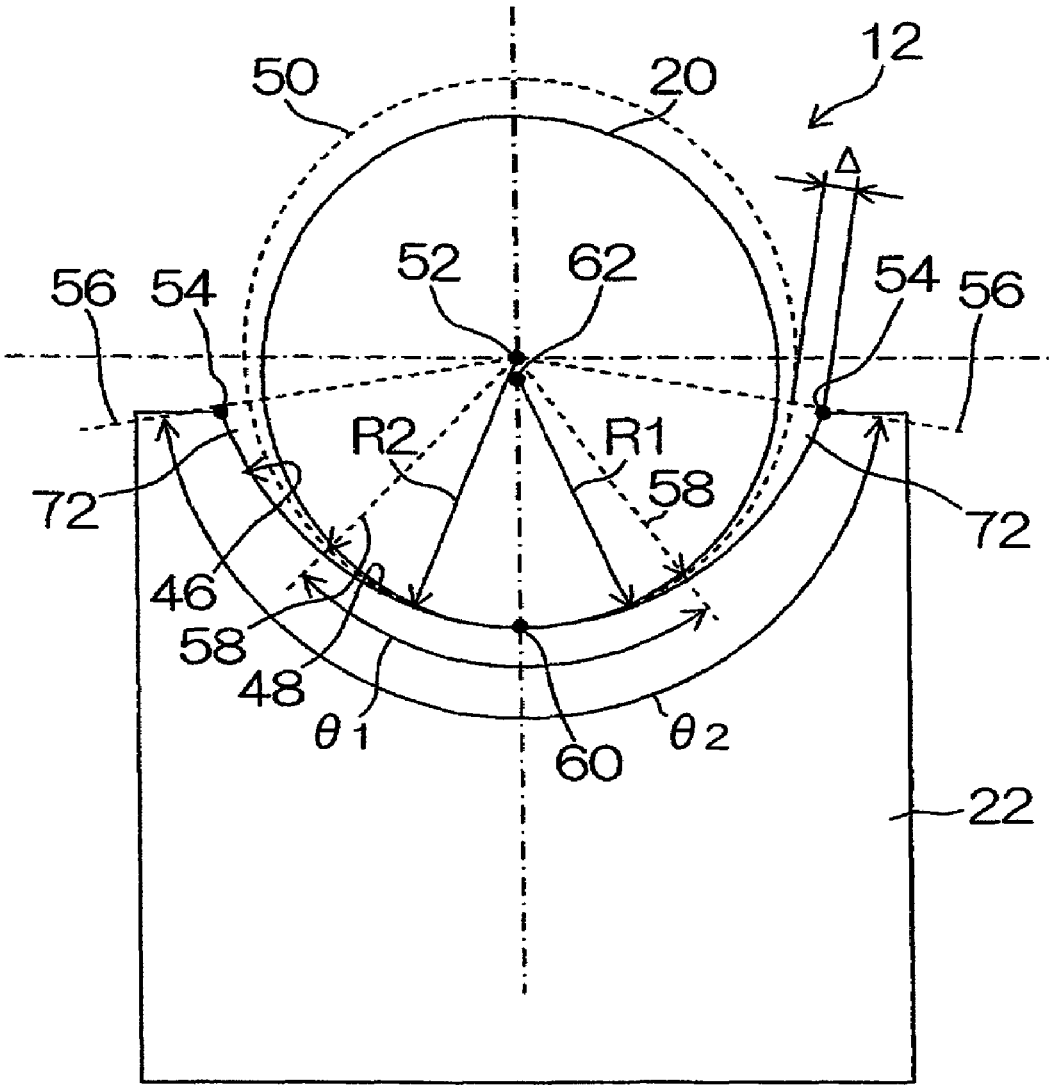
FIG. 8 is a diagram illustrating a relationship between the bar at a coating head of the bar coating apparatus of the present invention and bar support surface.

As shown in FIG. 8, the cross-sectional shape corresponding to the bar diameter direction on the bar support surface 46 which supports the bar 20 of the bar receiving member 22 is a recessed shape having at least an arc part 48 which receives the bar 20 and when the bar 20 is supported by the bar support surface 46 while the bar is not rotating, the bar support surface 46 is formed with respect to the bar 20 so as to satisfy all the following formulas:

$$40° \leqq \theta 1 < \theta 2 \leqq 180° \quad \text{Formula 1}$$

$$1.01 \leqq R2/R1 \leqq 1.20 \quad \text{Formula 2}$$

$$\Delta \geqq 0.03 \text{ mm} \quad \text{Formula 3}$$

where R1 is the radius of the bar 20, R2 is the curvature radius of the arc part 48 of the bar support surface 46, θ1 is a hold angle of the bar support surface 46, at which the bar 20 is held, θ2 is a bar support surface area angle formed by 2 virtual lines 56 which connect the center 52 of a virtual circle 50 having the curvature radius of R2 and both edges 54 of the bar support surface 46, and A is the distance from the intersections of the virtual lines 56 and perimeter of the virtual circle 50, to the edges 54.

Here, the hold angle θ1 refers to an angle formed by straight lines 58, 58 drawn from the center 52 of the virtual circle 50 which is formed with the curvature radius R2 to both ends of the contact arc part of the arc part 48 of the bar support surface 46 at which the bar 20 contacts the bar support surface 46. That is, it refers to the angle of a portion where the bar 20 contacts the bar support surface 46 and is thereby held (embraced). Furthermore, when tangents are sequentially drawn from the center position 60 (central position of the arc part) of the bar support surface 46 toward the end of the bar support surface 46, the horizontal tangent at the center position 60 gradually rises and changes to the lying direction and the edge 54 refers to this change point. The edge 54 refers to the position at which this change takes place. That is, a convex edge is formed when the tangent changes from the rising direction to the lying direction. The definition of this edge 54 will be explained in detail in FIG. 6 and FIG. 7. Reference numeral 62 denotes the center of the bar 20.

Figure 9:
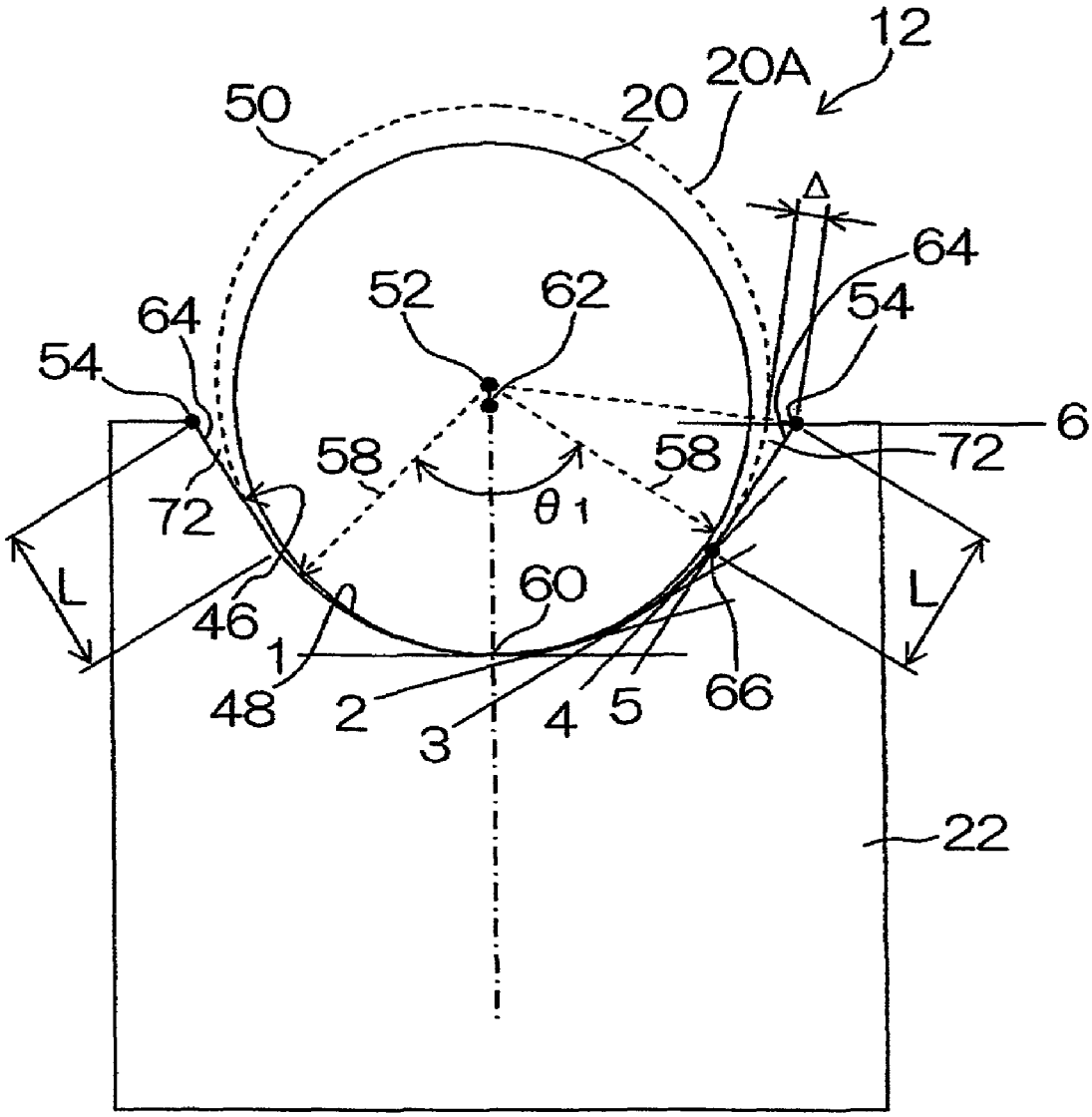
FIG. 9 is a diagram illustrating an edge when the bar support surface is made up of an arc part and rectilinear part.

FIG. 9 is a desirable example where the bar support surface 46 is formed so as to satisfy the above described three Formulas 1 to 3 and a portion of the bar support surface 46 which continues from both ends of the arc part 48 to the edge 54 is formed of a rectilinear part 64 of length L. By forming the bar support surface 46 of the arc part 48 and rectilinear part 64 in this way, it is possible to increase the hold angle θ1 at which the arc part 48 holds the bar 20 onto the bar support surface 46 and the rectilinear part 64 which continues from the arc part 48 causes the edge 54 to easily escape outward with respect to a perimeter 20A of the bar 20. The length L of the rectilinear part is the length enough to make Δ0.03 mm or more. Furthermore, the boundary 66 between the arc part 48 and rectilinear part 64 is preferably located closer to the edge 54 than the area of the hold angle θ1. This prevents any obtuse angle (edge) that contacts the bar 20 from being formed on the boundary 66 between the arc part 48 and rectilinear part 64.

Furthermore, when the bar support surface 46 is formed of the arc part 48 and rectilinear part 64, tangents 1 to 5 gradually rise and the tangent 5 overlaps with the rectilinear part L. A tangent 6 that contacts the edge surface changes from the rising direction to the lying direction. Therefore, the point of intersection of the tangent 5 and tangent 6 becomes the edge 54 on the right (right in FIG. 9) of the bar support surface 46. The edge 54 on the left side (left in FIG. 9) of the bar support surface 46 is likewise the position at which the tangent changes from the rising direction to the lying direction.

Furthermore, the straightness of the bar support surface 46 in the longitudinal direction is preferably equal to or less than 0.2 mm per 1 m of the bar and more preferably equal to or less than 0.1 mm.

Next, the application method of applying a coating liquid to the web 18 using the bar coating apparatus 10 configured as shown above will be explained.

The coating liquid is supplied into the liquid supply channels 24, 26 of the coating head 12 and forms the beads 36, 38 on the primary side and the secondary side, is picked up by the rotating bar 20 and applied to the web 18. In this case, the amount of coating liquid is measured at the contact between the web 18 and bar 20 and only a desired amount of coating is applied to the web 18 and the rest flows downward along the outside surface of the shuttering members 28, 30. That is, in case of bar coating, the coating liquid is applied to the web 18 through the beads 36, 38.

To form and appropriately maintain the beads 36, 38, the amount of coating liquid Q1 picked up by the bar 20 is required to be equal to or greater than the amount of coating liquid Q2 applied to the web 18. Generally, when Q1>Q2, the input of the coating liquid to the bead 36 on the primary side becomes greater than the output, and therefore when the size of the primary side bead 36 is kept constant, this excess coating liquid flows out of the primary side bead 36. That is, part of the excess coating liquid scraped off the bar 20 overflows beyond the shuttering member 28 and flows downward along the outside surface of the shuttering member 28. This overflowing coating liquid which flows downward is collected and reused as a coating liquid again.

Furthermore, when the rotation speed of the bar 20 becomes excessive, bubbles may be entrapped between the bar 20 and the vicinity of the contact part downstream of the web 18 causing coating faults depending on the type of the coating liquid. Since these bubbles are believed to occur when the air existing between the bar 20 and the bar receiving member 22 is entangled through the rotation of the bar 20, to prevent this, it is preferable to also supply the coating liquid toward the bar 20 downstream of the bar 20 as shown in FIG. 1, make it overflow from the shuttering member 30, form the secondary side bead 38 for prevention of bubbles and prevent the air from being entangled into the upstream.

According to the bar coating apparatus 10 according to this embodiment explained above, the average inclination D* of the bar 20 is set to $D^* \leqq 135\times10^{-6}$, and it is possible to rotate the bar 20 accurately by being supported by the bar support surface and thereby suppress traverse step-like unevenness during bar coating.

Furthermore, the embodiment adopts, not an average inclination of the deflection value A of the difference between the maximum and minimum values of roundness of the bar 20 as average inclination D* of the bar 20, but a width average of the absolute value $|dT/dX|$ of the differential value of the value T in the width direction X obtained by subtracting the value B which is obtained by a second-order approximation of A in the width direction X from this A, and therefore even when the bar 20 which is normally deflected to an extent, it is possible to distinguish the bar 20 whose deflection can be removed by pressing the bar 20 against the web 18 during coating and enables to coat the web without coating unevenness, and use it for the coating apparatus. In this way, it is possible to suppress the occurrence of coating faults such as traverse step-like unevenness during bar coating using the coating apparatus.

The bar 20 whose value of average inclination D* falls within a predetermined range can be obtained as follows. That is, the deflection value of the bar 20 is measured using a laser displacement gauge and the average inclination D* is calculated based on the measurement result of the deflection value. When the average inclination D* does not fall within the predetermined range, the bar 20 is annealed, the bending condition of the bar 20 is adjusted using a bending adjuster, the deflection value is then measured again and the average inclination D* is calculated based on the measurement result of the deflection value. This series of operations is repeated until the average inclination D* of the bar 20 falls within the predetermined range.

The coating liquid used in the embodiment is not particularly limited and an aqueous solution or organic solvent solution of polymer compound, pigment aqueous dispersion, colloidal solution or the like can be used. Furthermore, the physical property of the coating liquid is not particularly limited either, but lower viscosity is adequate and a coating liquid of 1 Pa·s or below and 0.5 Pa·s or below in particular is appropriate. Surface tension is not particularly limited either, but preferable effects are obtained with $50\times10^{-3}$ N/m or less in particular.

Furthermore, as the web 18 used in the embodiment, paper, plastic film, resin coated paper, synthetic paper or the like is included. As the material of the plastic film, for example, polyolefin such as polyethylene, polypropylene, vinyl polymer such as polyvinyl acetate, polyvinyl chloride, polystyrene, polyamide such as 6,6-nylon, 6-nylon, polyester such as polyethylene terephthalate, polyethylene-2,6-naphthalate, polycarbonate, cellulose acetate such as cellulose triacetate, cellulose diacetate or the like are used. Furthermore, as the resin used for resin coated paper, polyolefin including polyethylene is a typical example, but the resin is not always limited to this. The thickness of the web is not particularly limited either, but a thickness on the order of 0.01 mm to 1.0 mm inclusive is advantageous from the standpoint of handling and general-purpose properties.

Figure 10:
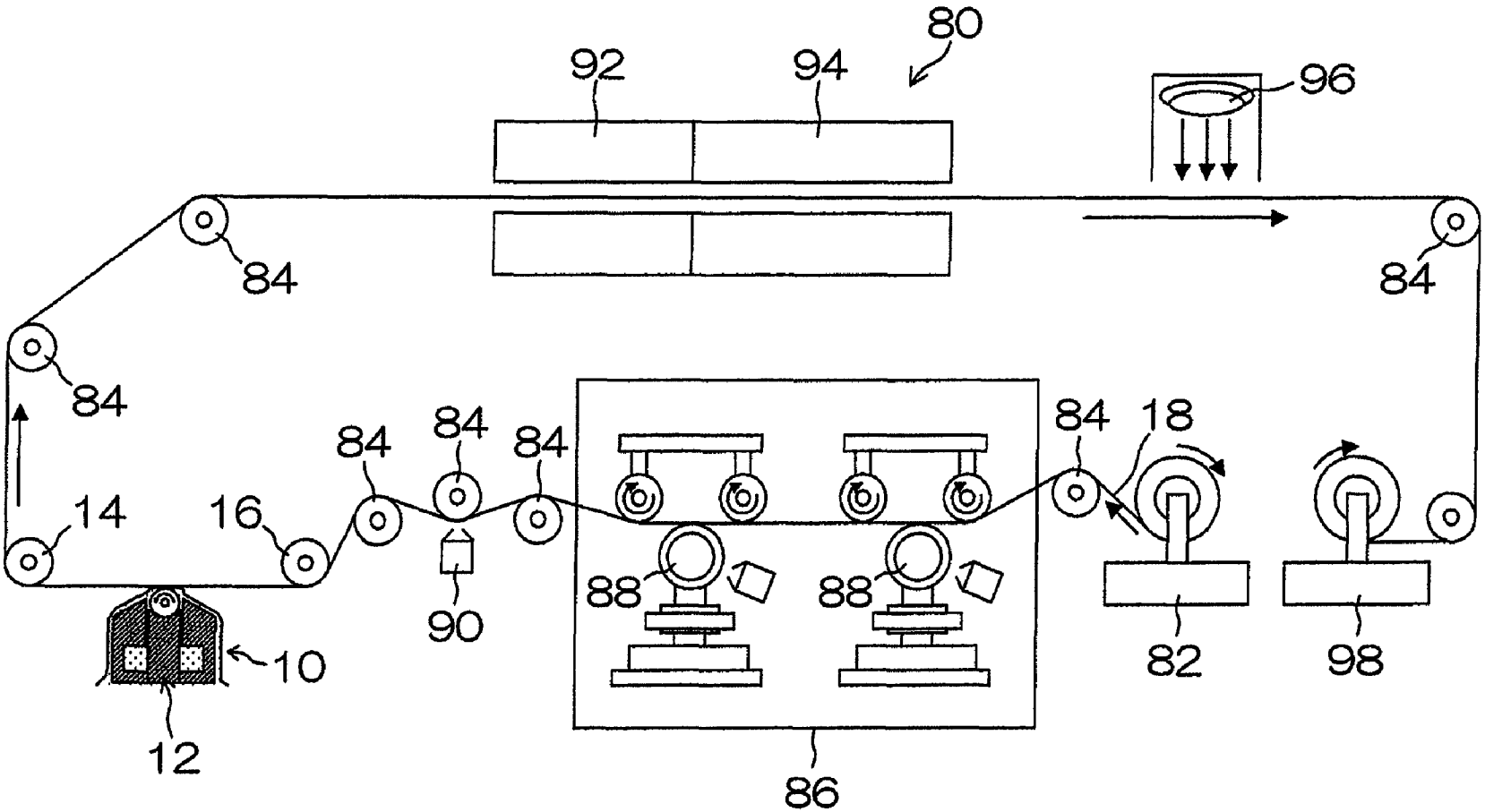
FIG. 10 is a diagram illustrating an optically compensated sheet manufacturing line incorporating the bar coating apparatus of the present invention.

FIG. 10 shows an optically compensated sheet manufacturing line 80 which incorporates the bar coating apparatus 10 of the present invention.

As shown in FIG. 10, in the optically functional film manufacturing line 80, the web 18 which is a transparent support body on which a polymer layer for forming an alignment layer is formed beforehand is sent out from a delivery unit 82. Next, the web 18 is guided by a guide roller 84 and sent into a rubbing processing apparatus 86 and a rubbing roller 88 performs rubbing processing on the polymer layer. A dust catcher 90 is provided downstream of the rubbing roller 88, which removes dust stuck to the surface of the web 18. The bar coating head 12 of the embodiment is provided downstream of the dust catcher 90 and the coating liquid which contains disconematic liquid crystal is applied to the web 18. A drying zone 92 and a heating zone 94 are provided downstream of the coating head 12 in order and the coating liquid on the web 18 is dried and heated and a liquid crystal layer is formed. Furthermore, an ultraviolet ray lamp 96 is provided downstream of this, which bridges the liquid crystal through irradiation of ultraviolet rays and forms a desired polymer. An optically compensated film is thereby manufactured and the manufactured optically compensated film is wound up by a winder 98.

EXAMPLES

Example 1

An optically compensated film was manufactured using the optically compensated film manufacturing line 80 which incorporates the bar coating apparatus 10 of the present invention shown in FIG. 10.

The web 18 used was a resin layer for an alignment layer formed by applying a 2 weight percent solution of long-chain alkyl denatured polyvinyl alcohol onto the surface of cellulose triacetate (FUJITAC manufactured by FUJIFILM Corporation) having a thickness of 100 μm so as to be 25 ml per 1 $m^2$ of the film and drying this at 60° C. for one minute. The delivery unit 82 sent out this web 18 and while transporting the web 18 at 50 m/min, the rubbing processing apparatus 86 performed rubbing processing on the surface of the resin layer for an alignment layer and formed an alignment layer. The pressing pressure by the rubbing roller 88 during rubbing processing was set to $9.8\times10^5$ Pa per 1 $cm^2$ of the resin layer for an alignment layer and the rotation circumferential velocity was set to 5.0 m/sec.

The coating liquid was then applied onto the alignment layer obtained through rubbing processing on the resin layer for an alignment layer using the bar coating apparatus 10 of the embodiment. For the coating liquid, 10 weight percent of ethylene oxide denatured trimethylol propane triacrylate (V#360, manufactured by Osaka Organic Chemical Industry Ltd.), 0.6 weight percent of cellulose acetate butyrate (CAB531-1, Eastman Chemical Company), 3 weight percent of photo polymerization initiator (IRGACURE 907 manufactured by Nihon Ciba-Geigy K.K), 1 weight percent of sensitizer (KAYACURE DET-X manufactured by Nippon Kayaku Co., Ltd.) were added to a mixture of R(1) and R(2) of discotic compound TE-8 at a weight ratio of 4:1 shown below to finally obtain a 32 weight percent methyl ethyl ketone solution of the mixture. 0.3 weight percent of fluorine-based surface active agent (fluoroaliphatic group containing copolymer, Megafac F780 manufactured by Dainippon Ink and Chemicals Incorporated) was further added to the liquid containing the liquid crystal compound and used as the coating liquid.

[Chemical formula 1]

TE-8

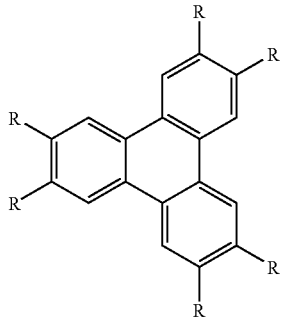

R (1)

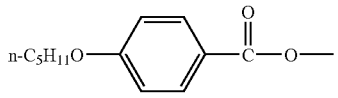

-continued

R (2)

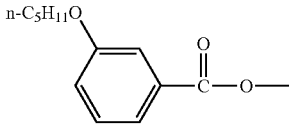

Next, the wire bar 20 (bar No. A) having a bar diameter of 8 mm, deflection value of 50 μm, average inclination D* of $36\times10^{-6}$ and wire diameter of 0.06 mm was supported by the bar support surface 46 having straightness of 0.1 mm per 1 m of the bar, while running the web 18 at a running speed of 20 m/min, the wire bar 20 was also rotated forward at the same speed and the coating liquid was applied onto the alignment layer so as to be 5 ml per 1 $m^2$ of the web from the bar coating head 12. The deflection value of the bar was measured using a non-contact laser displacement gauge (LS-7030R manufactured by KEYENCE CORPORATION).

In this case, as for the bar support surface 46 of the bar receiving member 22 of the coating head 12, R2/R1 was 1.07, hold angle θ1 of the bar 20 on the bar support surface 46 was 74°, bar support surface area angle θ2 was 102° and distance Δ was 0.09 mm. That is, this corresponds to the case where all the conditions of Formulas 1 to 3 required for the bar support surface 46 of the bar receiving member 22 are satisfied.

$$40° \leqq \theta 1 < \theta 2 \leqq 180° \quad \text{Formula 1}$$

$$1.01 \leqq R2/R1 \leqq 1.20 \quad \text{Formula 2}$$

$$\Delta \geqq 0.03 \text{ mm} \quad \text{Formula 3}$$

The web 18 to which the coating liquid was applied at the bar coating head 12 having this bar receiving member 22 was passed through the drying zone 92 adjusted to 100° C. and the heating zone 94 adjusted to 130° C. to form a nematic phase, then while continuously transporting the web 18 coated with this alignment layer and liquid crystal compound phase, UV rays were irradiated onto the surface of the liquid crystal layer using the UV lamp 96. An optically compensated film was manufactured in this way.

Example 2

An optically compensated film was manufactured in the same way as Example 1 except in that the wire bar 20 (bar No. B) having a bar diameter of 8 mm, deflection value of 49 μm, average inclination D* of $54.2\times10^{-6}$ and wire diameter of 0.06 mm was supported by the bar support surface 46 having straightness of 0.1 mm per 1 m of the bar.

Example 3

An optically compensated film was manufactured in the same way as Example 1 except in that the wire bar 20 (bar No. C) having a bar diameter of 8 mm, deflection value of 48 μm, average inclination D* of $61.7\times10^{-6}$ and wire diameter of 0.06 mm was supported by the bar support surface 46 having straightness of 0.1 mm per 1 m of the bar.

Example 4

An optically compensated film was manufactured in the same way as Example 1 except in that the wire bar 20 (bar No. D) having a bar diameter of 8 mm, deflection value of 55 μm, average inclination D* of $88.9\times10^{-6}$ and wire diameter of 0.06 mm was supported by the bar support surface 46 having straightness of 0.1 mm per 1 m of the bar.

Example 5

An optically compensated film was manufactured in the same way as Example 1 except in that the wire bar 20 (bar No. E) having a bar diameter of 8 mm, deflection value of 54 μm, average inclination D* of $130\times10^{-6}$ and wire diameter of 0.06 mm was supported by the bar support surface 46 having straightness of 0.1 mm per 1 m of the bar.

Example 6

An optically compensated film was manufactured in the same way as Example 1 except in that the wire bar 20 (bar No. F) having a bar diameter of 6 mm, deflection value of 390 μm, average inclination D* of $108\times10^{-6}$ and wire diameter of 0.06 mm was supported by the bar support surface 46 having straightness of 0.1 mm per 1 m of the bar.

Example 7

An optically compensated film was manufactured in the same way as Example 1 except in that the wire bar 20 (bar No. G) having a bar diameter of 6 mm, deflection value of 284 μm, average inclination D* of $105\times10^{6}$ and wire diameter of 0.06 mm was supported by the bar support surface 46 having straightness of 0.1 mm per 1 m of the bar.

Comparative Example 1

An optically compensated film was manufactured in the same way as Example 1 except in that the wire bar 20 (bar No. H) having a bar diameter of 8 mm, deflection value of 48 μm, average inclination D* of $136\times10^{-6}$ and wire diameter of 0.06 mm was supported by the bar support surface 46 having straightness of 0.1 mm per 1 m of the bar.

Comparative Example 2

An optically compensated film was manufactured in the same way as Example 1 except in that the wire bar 20 (bar No. J) having a bar diameter of 8 mm, deflection value of 68 μm, average inclination D* of $160\times10^{-6}$ and wire diameter of 0.06 mm was supported by the bar support surface 46 having straightness of 0.1 mm per 1 m of the bar.

Comparative Example 3

An optically compensated film was manufactured in the same way as Example 1 except in that the wire bar 20 (bar No. J) having a bar diameter of 8 mm, deflection value of 44 μm, average inclination D* of $161\times10^{-6}$ and wire diameter of 0.06 mm was supported by the bar support surface 46 having straightness of 0.1 mm per 1 m of the bar.

Comparative Example 4

An optically compensated film was manufactured in the same way as Example 1 except in that the wire bar 20 (bar No. K) having a bar diameter of 8 mm, deflection value of 52 μm, average inclination D* of $164\times10^{-6}$ and wire diameter of 0.06 mm was supported by the bar support surface 46 having straightness of 0.1 mm per 1 m of the bar.

Comparative Example 5

An optically compensated film was manufactured in the same way as Example 1 except in that the wire bar 20 (bar No. L) having a bar diameter of 8 mm, deflection value of 56 μm, average inclination D* of $181\times10^{-6}$ and wire diameter of 0.06 mm was supported by the bar support surface 46 having straightness of 0.1 mm per 1 m of the bar.

Comparative Example 6 optically compensated film was manufactured in the same way as Example 1 except in that the wire bar 20 (bar No. M) having a bar diameter of 6 mm, deflection value of 162 μm, average inclination D* of $244\times10^{-6}$ and wire diameter of 0.06 mm was supported by the bar support surface 46 having straightness of 0.1 mm per 1 m of the bar.

(Conclusion)

As for evaluation items, traverse step-like unevenness produced in the width direction of the web 18 was visually evaluated for every turn of the bar 20. As for evaluation levels in quality evaluations of the optically compensated film, levels satisfying the manufacturing quality are marked "G" and levels failing to satisfy the manufacturing quality are marked "P".

The results of Examples 1 to 7 and Comparative Examples 1 to 6 are shown in Table 1.

TABLE 1

| | Bar No. | Diameter of bar (mm) | Deflection value (μm) | Average inclination D* ($\times10^{-6}$) | Average inclination without second-order approximation D ($\times10^{-6}$) | Traverse step-like unevenness |
|---|---|---|---|---|---|---|
| Ex. 1 | A | φ8 | 50 | 36 | 65.29 | G |
| Ex. 2 | B | φ8 | 49 | 54.2 | 56.39 | G |
| Ex. 3 | C | φ8 | 48 | 61.7 | 60.2 | G |
| Ex. 4 | D | φ8 | 55 | 88.9 | 87.76 | G |
| Ex. 5 | E | φ8 | 54 | 130 | 130.16 | G |
| Ex. 6 | F | φ6 | 390 | 108 | 348 | G |
| Ex. 7 | G | φ6 | 284 | 105 | 208 | G |
| Com. Ex. 1 | H | φ8 | 48 | 136 | 139.91 | P |
| Com. Ex. 2 | I | φ8 | 68 | 160 | 159.41 | P |
| Com. Ex. 3 | J | φ8 | 44 | 161 | 158.14 | P |
| Com. Ex. 4 | K | φ8 | 52 | 164 | 166.19 | P |
| Com. Ex. 5 | L | φ8 | 56 | 181 | 181.46 | P |
| Com. Ex. 6 | M | φ6 | 162 | 244 | 249 | P |

It is clear from Table 1 that satisfying the condition that the value of average inclination D* is equal to or less than $135\times10^{-6}$ regardless of the value of the deflection value A is a requirement for suppressing generation of coating faults of traverse step-like unevenness. Especially in Examples 6 and 7, since the value of the inclination D* is equal to or less than $135\times10^{-6}$ though the value of deflection value A is large, it is possible to form a coating film without traverse step-like unevenness on the web.

As for the bar in Example 6, though the average inclination D without second-order approximation is calculated to be 348, the average inclination D* is calculated to be 108 and it is clear from Table 1 that no traverse step-like unevenness occurs in the coated film. This shows that when the bar which is normally deflected to an extent is pressed against the web, the bar is spread out and the deflection is removed and it is thereby possible to form a coating film without traverse step-like unevenness on the web.

Therefore, it is evident that forming a coating film on the web using the bar whose value of average inclination D* is equal to or less than $135\times10^{-6}$ is effective in preventing traverse step-like unevenness.

What is claimed is:

1. A bar coating method of applying a coating liquid to a continuously running web using a columnar bar which rotates by being supported by a bar receiving member, comprising steps of:

checking whether the bar satisfies $D^*\leqq135\times10^{-6}$ where A is a deflection value of a difference between a maximum value and minimum value of roundness of the bar, B is a value obtained by a second-order approximation of A in a longitudinal direction of the bar, T (=A−B) is a value obtained by subtracting B from A, and D* is an average inclination which is an average of a bar width of an absolute value $|dT/dX|$ of a differential value of T in the longitudinal direction of the bar, and coating the web with the bar which has been checked in the checking step so that the average inclination D* satisfies $D^*\leqq135\times10^{-6}$.

* * * * *